US010954028B1

(12) United States Patent
Forenza

(10) Patent No.: US 10,954,028 B1
(45) Date of Patent: Mar. 23, 2021

(54) CHILD RESISTANT LOCKABLE CONTAINER

(71) Applicant: Jam Packaging LLC, Miami Gardens, FL (US)

(72) Inventor: Michael Forenza, Miami Gardens, FL (US)

(73) Assignee: JAM PACKAGING LLC, Miami Gardens, FL (US)

( * ) Notice: Subject to any disclaimer, the term of this patent is extended or adjusted under 35 U.S.C. 154(b) by 49 days.

(21) Appl. No.: 16/598,021

(22) Filed: Oct. 10, 2019

(51) Int. Cl.
*B65D 83/04* (2006.01)
*B65D 5/38* (2006.01)

(52) U.S. Cl.
CPC ..... *B65D 5/38* (2013.01)

(58) Field of Classification Search
CPC ..... B65D 5/38; B65D 11/12
USPC ..... 206/1.5, 468, 528, 531, 536, 557, 560, 206/565, 807; 220/8
See application file for complete search history.

(56) References Cited

U.S. PATENT DOCUMENTS 4,007,828 A * 2/1977 Mayled ..... B65D 11/12 206/1.5
4,076,117 A * 2/1978 Wisdom ..... A24F 27/00 206/106
4,126,224 A * 11/1978 Laauwe ..... B65D 50/06 206/540
4,561,544 A * 12/1985 Reeve ..... B65D 11/12 206/1.5
5,275,291 A * 1/1994 Sledge ..... B65D 43/20 206/1.5
7,854,325 B2 * 12/2010 Bentele ..... B65D 5/38 206/531
8,453,840 B2 * 6/2013 Wharton ..... B65D 11/12 206/531
2004/0099565 A1 * 5/2004 Dehlin ..... B65D 50/046 206/536
2009/0152134 A1 * 6/2009 Katsis ..... A24F 27/00 206/96

* cited by examiner

*Primary Examiner* — Luan K Bui
(74) *Attorney, Agent, or Firm* — Lott & Fischer, P.L.

(57) ABSTRACT

The invention provides an apparatus for container. The container comprises a sleeve element and a tray element. Both the sleeve element and tray element comprise holes through the sides of their respective walls. In a locked position the tray element is substantially housed within the sleeve element. The apparatus further comprises a foam insert disposed within an open area of the tray element. Located between the wall of the tray element and foam insert, a button extends through the hole of the tray element. In a locked position, the button further extends through the hole of the sleeve element. The button may be depressed upon the foam insert to unlock the tray element from the foam insert.

9 Claims, 8 Drawing Sheets

CHILD RESISTANT LOCKABLE CONTAINER

FIELD OF INVENTION

The present invention relates to a container. More specifically, the container may be locked and unlocked by the depression of a button against a resilient foam.

BACKGROUND

Many items contained in a person's household may pose dangers due to accidental encounters with those items by persons or animals not intended to have access to such items. The owners of these items often wish to secure the items in a manner whereby unauthorized or unintended users cannot access them. One way to limit access to such persons or animals is to make it difficult for one to accidently or unintentionally open containers containing items that may pose a risk, often accomplished by the use of a type of locking mechanism. Therefore, there exist containers that require specific manipulation to retrieve the contents within the container. Types of these containers include medicine bottles that require a cap to be depressed and rotated to a certain degree, as well as food containers that may feature certain latches or locks.

These containers can often be overcomplicated and difficult for even an ordinary person to quickly access the contents within the container. Further, the manufacturing costs of the containers may be quite high due to the complexity of the locking mechanism and material used for the container. The current state of the art further lacks a simple configuration for a small lockable container in the shape of a box or rectangular prism.

Therefore, there is a need in the art for a container that is easily opened by an adult, but resistant to accidental or unintentional opening by a child or pet. There is a further need in the art for a configuration of a lockable rectangular prism that is cheap to manufacture and simple to use.

BRIEF SUMMARY OF INVENTION

It is among the objects of this disclosure to overcome the limitations and defects of the heretofore-known devices by providing inventive features to achieve a lockable container that can be easily manipulated between a closed and opened position. The disclosure provides a lockable container comprising a tray element and a sleeve element. In a locked position, the tray element is completely housed within a pocket of the sleeve element. In an unlocked position, the tray element may exit the pocket through an entrance, defined by an entrance rim. The dimensions of the pocket of the sleeve element are significantly similar to that of the tray element. The tray element may have at least one wall and a base that define an open area within. At least one wall further contains a hole therethrough. A sidewall of the sleeve element that corresponds to the wall of the tray element when the tray element is housed within the sleeve element also contains a hole therethrough. The location of the hole of the sleeve element is aligned with the hole of the tray element when the tray element is in the locked position.

The container further comprises a foam insert and a button. The foam insert may be situated in the open area of the tray element and proximate the hole of the tray element. The button is located between the foam insert and the tray element and extends distally through the hole of the tray element. In the locked position, the button also extends distally through the hole of the sleeve element, whereby the tray element is secured in the pocket of the sleeve element because of the contact between the button and the edges of the hole of the sleeve element.

The button and foam insert are designed so that the button may be depressed against the foam insert. When the button is depressed to a distance lower than that of the sidewall of the sleeve element, the tray element is no longer locked to the sleeve element. The sleeve element may further comprise an opening at the end opposite of the entrance to the pocket, allowing a user of the container to push the tray element out through the entrance once the button has been depressed and the tray has been unlocked.

The sleeve element may further contain a stopping mechanism adapted for obstructing the complete removal of the tray element from the pocket of the sleeve element. In one embodiment, the sleeve element may further comprise a tab located at an edge of the entrance rim and folded inwardly into the pocket. The tab is located on the edge of the entrance rim corresponding with the wall of the tray element where the button is located. Thereby, when the tray element is sliding out of the pocket of the sleeve element, the button will contact the tab prior to the complete removal of the tray element. The tab will hinder the passage of the button unless an excess amount of force is used to cause the tab to fold in on itself.

In one embodiment, multiple buttons are employed in the manner above and manipulated simultaneously to unlock the tray element. In another embodiment, multiple holes may be featured at different locations and different sidewalls of the sleeve element so that the tray element may be inserted into the pocket in any possible orientation and the button will still engage at least one hole.

DETAILED DESCRIPTION OF THE INVENTION

Implementations of the invention provide a container adapted to secure an object within using a locking mechanism that may be quickly manipulated from a locked position to an unlocked position and vice versa.

Figure 1:
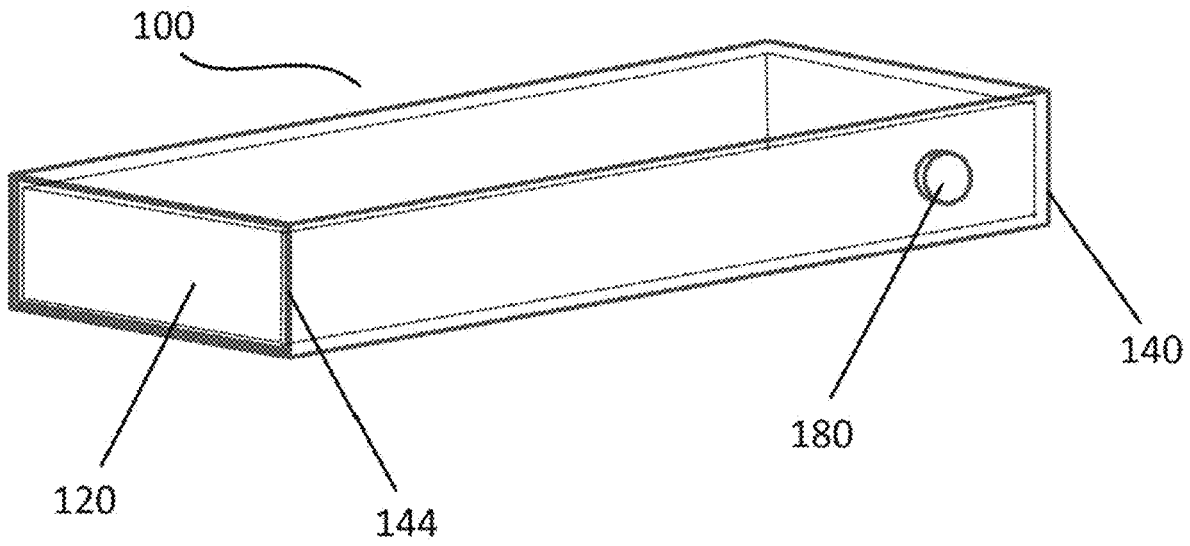
FIG. 1 is a perspective view of the apparatus in a locked position in accordance with one embodiment of the present disclosure.

The lockable container 100 of the present disclosure is shown in the accompanying drawings. As shown in FIG. 1, the container 100 generally comprises a tray element 120 and a sleeve element 140. The tray element 120 is adapted to be housed within a pocket of the sleeve element 140. The dimensions of the tray element 120, such as its height, width, and length, substantially correspond to the inner dimensions of the pocket of the sleeve element 140, whereby the tray element 120 may be completely housed within the sleeve element 140. The sleeve element 140 further comprises an entrance, defined by an entrance rim 144. The tray element 120 may enter the sleeve element 140 through the entrance of the sleeve element 140. Although depicted in the figures as a rectangular prism, the container 100 may have any configuration, such as a cylinder, box, elliptical tube, or any other configuration known in the art.

Figure 2:
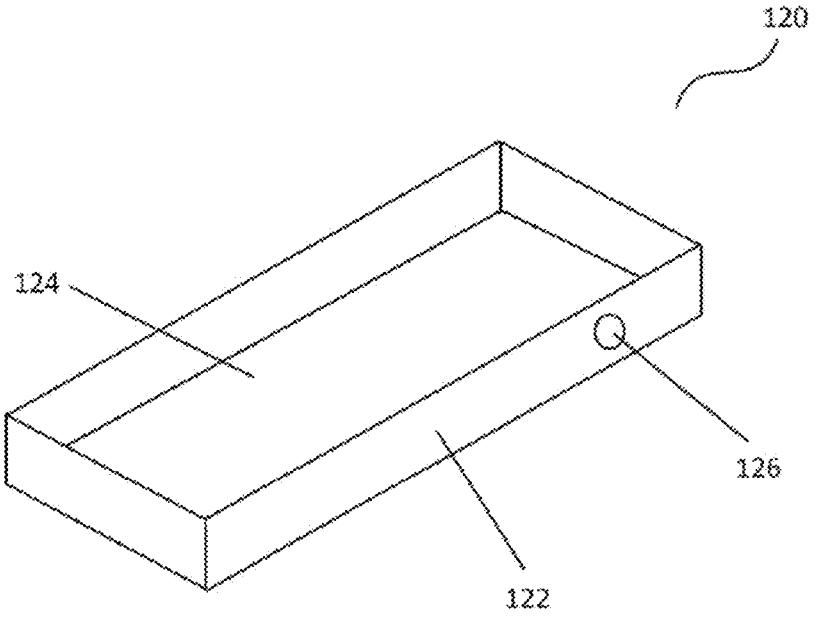
FIG. 2 is a perspective view of the tray element of the apparatus in accordance with one embodiment of the present disclosure.

As shown in FIG. 2, the tray element 120 may comprise at least one wall 122 and a base 124. The wall 122 and base 124 define an open area. In one embodiment of the container 100, the tray element 120 comprises four walls 122 extending upward from the edge of the base 124 of the tray element 120. The tray element 120 further comprises a hole 126 through the wall 122 or base 124. The hole 126 may be through any face that is not opposite the entrance of the pocket of the sleeve element 140 when the tray element 120 is disposed within the sleeve element 140. The hole 126, as shown, may be circular in shape. However, the hole 126 may be configured in any shape whatsoever, such as square, rectangular, or crescent. The position of the hole 126, as shown, may be proximate an end opposite the entrance of the pocket of the sleeve element 140 when the tray element 120 is housed within the sleeve element 140; however, the hole 126 may be located at any position on the wall 122, including the center of the length of the wall 122 or proximate the entrance of the pocket of the sleeve element 140.

Figure 3A:
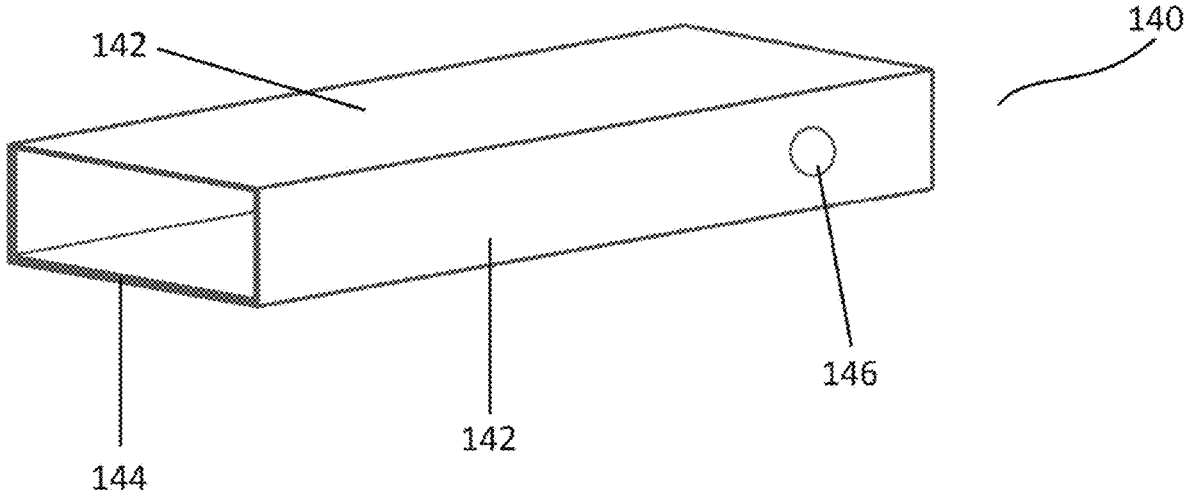
FIGS. 3A and 3B are top and bottom perspective views of the sleeve element of the apparatus in accordance with one embodiment of the present disclosure.
Figure 3B:
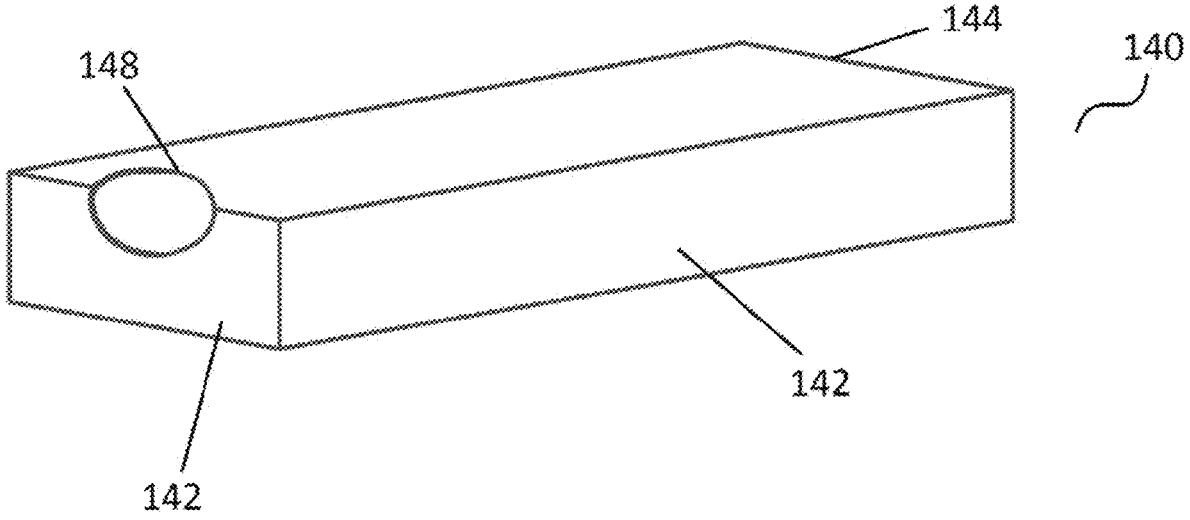

As shown in FIGS. 3A and 3B, the sleeve element 140 may comprise of one or more sidewalls 142. In one embodiment, the sleeve element 140 comprises five sidewalls 142 defining the pocket of the sleeve element 140. As shown in FIG. 3A, the entrance to the pocket, defined by the entrance rim 144, is located on a side of the sleeve element 140 corresponding to a smallest face of the container 100. However, the entrance of the pocket of the sleeve element 140 may be located on any face of the container regardless of the area of that face.

The sleeve element 140 is further comprised of a hole 146 through at least one sidewall 142. The position of the hole 146 of the sleeve element 140 corresponds with the position of the hole 126 of the tray element 120, when the tray element 120 is housed within the sleeve element 140. Further, the size and shape of the hole 146 of the sleeve element 140 also corresponds to the size and shape of the hole 126 of the tray element 120. Thus, when the tray element 120 is fully housed within the sleeve element 140, the hole 126 of the tray element 120 and the hole 146 of the sleeve element 140 are substantially aligned so that an opening exists from the open area of the tray element 120 to outside the sleeve element 140.

In one embodiment of the disclosure the sleeve element 140 may also be comprised of an opening on one or more sidewalls 142. The opening may be defined by an opening edge 148. The opening is adapted for assisting a user of the container to either push or pull the tray element 120 out of the pocket of the sleeve element 140. In one embodiment, as demonstrated in FIG. 3B, the opening is at an edge between two sidewalls 142 on an end of the sleeve element 140 opposite the entrance to the pocket. Thereby, a user may use push the tray element 120 via the opening at least partially out of the pocket of the sleeve element 140. Subsequently, the user may grab the partially removed tray element 120 and pull to further remove the tray element 120. Alternatively, the opening may be featured on opposite sidewalls 142 proximate to the entrance of the pocket of the sleeve element 140, whereby the user may grab tray element 120 via the opening and pull the tray element 120 at least partially out of the sleeve element 140.

Figure 4:
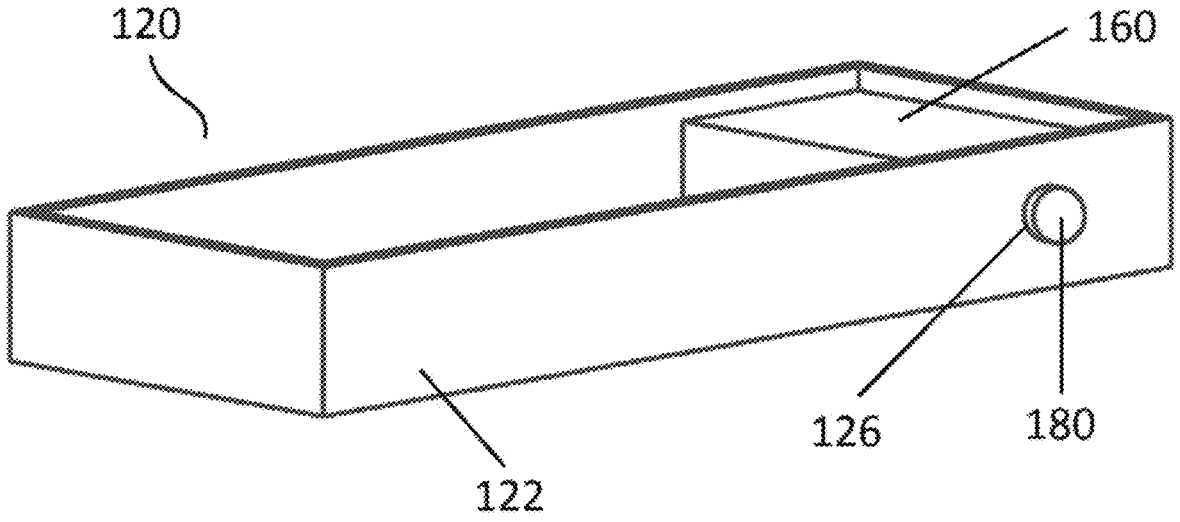
FIG. 4 is a perspective view of the tray element with the foam insert and button in accordance with one embodiment of the present disclosure.

As shown in FIG. 4, the container further comprises a foam insert 160. The foam insert 160 is situated within the open area of tray element 120. The foam insert 160 may be located proximate the hole 126 of the tray element 120. The height of the foam insert 160 may be at least that of the top of the hole 126 of the tray element 120. The width of the foam insert 160 may be substantially equal to the base 124 of the tray element 120, wherein a side of the foam insert 160 that is opposite a side proximate to the hole 126 of the sleeve element 120 is against a wall 122 of the tray element 120 or is against a sidewall 142 of the sleeve element 140 when the tray element 120 is housed within the sleeve element 140. The length of the foam insert 160 may extend the length of the open area or it may have a length that is slightly larger than the width of the hole 126, as demonstrated in FIG. 4. The foam insert 160 may be adhesively attached to the base 124 or wall 122 of the tray element 120. Alternatively, the foam insert 160 may be secured in the open area by opposing forces of opposing walls 122 of the tray element 120 compressing the foam insert 160.

Figure 5A:
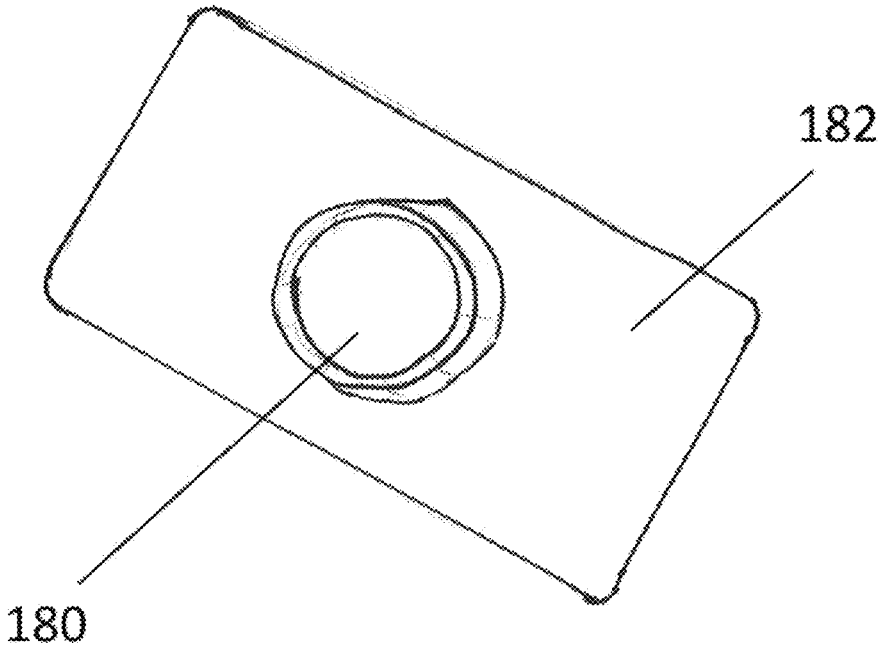
FIG. 5A is a perspective view of the button in accordance with one embodiment of the present disclosure.
Figure 5B:
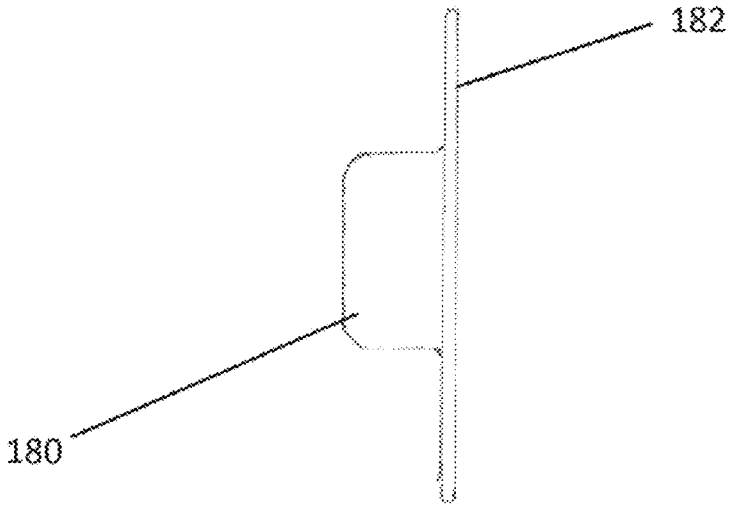
FIG. 5B is a side view of the button in accordance with one embodiment of the present disclosure.

The container 100 is further comprised of a button 180. The button 180 is disposed between the foam insert 160 and the wall 122 of the tray element 120. Referring to FIGS. 5A and 5B, the button 180 may comprise a button base 182 from which the button 180 extends. The button 180 extends distally out of the hole 126 of the tray element 120, as demonstrated in FIG. 4. The shape of the button 180 may correspond with the shape and size of the hole 126 of the tray element 120. However, the button 180 may be smaller than the size of the hole 126 of the sleeve element 120, whereby additional clearance is allowed between the button 180 and edges of the hole 126 of the tray element 120. The button base 182 may be a substantially flat surface surrounding a bottom edge of the outwardly extending button 180. The button base 182 may lay flat against an inner face of the wall 122 of tray element 120 so that the button 180 is secured between the tray element 120 and the foam insert 160.

In one embodiment, the button 180 and button base 182 may be held in place via compression by the wall 122 of the tray element 120 and the foam insert 160. In another embodiment, the button may be adhesively attached to a side of the foam insert 160. In yet another embodiment, the button 180 and the foam element 160 are manufactured as a unitary piece, with the button 180 extending distally from an outer face of the foam element 160.

When the container 100 is in a locked position, as shown in FIG. 1, the button 180 extends distally from the open area of the tray element 120 through both the hole 126 of the tray element 120 and the hole 146 of the sleeve element 126. Thereby, the tray element 120 is secured within the sleeve element 140 because any potential movement of the tray element 120 is hindered by a side of the button 180 pressing against an edge of the hole 146 of the sleeve element 140.

The tray element 120 may be partially removed from the sleeve element 140, by the depression of the button 180 upon the foam element 160. When the button 180 is depressed inwardly to a position whereby the button 180 does not extend substantially into the hole 146 of the sleeve element 140, the tray element 120 may partially pulled or pushed out of the sleeve element 140. A distal end of the button 180 may be tapered, whereby if the tapered end of the button 180 engages the edge of the hole 146 of the sleeve element, the force of the tapered end of the button 180 upon the edge of the hole 146 will cause the button to move beneath the edge and out of the hole 146, allowing for release of the tray element 120.

As the tray element 120 is removed from the pocket of the sleeve element 140, the button 180 slides against an inner face of the sidewall 142 of the sleeve element 140. In one embodiment, the tray element 120 may be completely removed from the sleeve element 140 once the button 180 passes out of the entrance to the pocket of the sleeve element 140. To reinsert the tray element 120 into the sleeve element 140, the button 180 must be depressed such that the tray element 120 and the outwardly extending button 180 may fit within the pocket of the sleeve element 140. Once the tray element is fully returned to a closed position, whereby the hole 126 of the tray element 120 align with the hole 146 of the sleeve element 140, the resilient nature of the foam insert 160 will push the button 180 once again through the hole 146 of the sleeve element 140. In one embodiment of the disclosure, the location of the button 180 and the location of the opening of the sleeve element are coordinated in a manner that a user may depress the button 180 and simultaneously push out the tray element 120 with a single hand.

Figure 6:
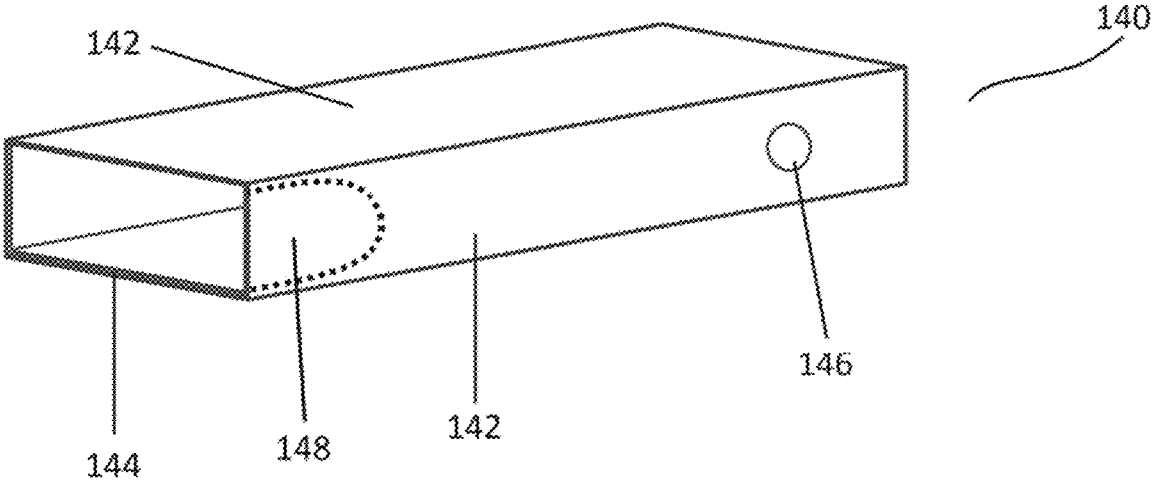
FIG. 6 is a perspective view of the apparatus detailing the locking mechanism in accordance with one embodiment of the present disclosure.

In another embodiment of the container 100, a stopping mechanism is located on an inner face of the sidewall 142 of the sleeve element 140. The stopping mechanism is adapted to engage the button 180, thereby hindering complete removal of the tray element 120 from the pocket of the sleeve element 140. As shown in FIG. 6, the stopping mechanism may be an inwardly folded tab 148 attached at the entrance rim 144 of the sleeve element 140. The tab 148 is located on the edge of the entrance rim 144 that corresponds to the sidewall 142 featuring the hole 146 of the sleeve element 140. Thereby, when the button 180 is depressed and the tray element 120 is being removed from the pocket of the sleeve element 140, a side face of the button 180 will contact the tab 148. As a majority of the tray element 120 is outside of the sleeve element 140, any object intended to be secured within the open area of the tray element 120 may be accessed or removed. However, the tray element 120 cannot be fully removed due to the obstruction of the button 180 caused by the contact with the tab 148, unless excessive force is used, causing the tab 148 to fold in on itself. Although disclosed in one embodiment as an inwardly folded tab 148, the stopping mechanism may take other forms. These include, but are not limited to, a protrusion featured on the inner face of the sidewall 142 of the sleeve element 140 adapted to obstruct the button 180 or a recess on the inner face of the sidewall 142 of the sleeve element 140 adapted to allow the button to expand into the recess and hinder the button 180 from sliding out of the pocket.

In another embodiment of the disclosure, the sleeve element 140 comprise a secondary hole (not shown), similar in size and shape to hole 146, on the same face of the sidewall 142 where the hole 146 of the sleeve element 140 is located. The secondary hole may be located more proximal to the entrance rim 144 than the hole 146, towards the end of the sleeve element 140 comprising the entrance to the pocket and in line with a path the button 180 travels along the inner face of the sidewall 142. The secondary hole is shaped and placed so that the button 180 will expand into the secondary hole upon reaching its location. This would effectively lock the tray element 120 in the open position, until the button is again depressed and the tray element 120 is either pulled further out from the sleeve element, or pushed further into the sleeve element 140 and optionally returned to the closed position.

In one embodiment of the disclosure, the sleeve element 140 may be manufactured a single flat piece and subsequently folded and glued to create the structure of the sleeve element 140. In this embodiment, the sleeve element 140 may feature inwardly folded tabs on each edge of the entrance rim 144. All tabs may be glued down to the inner face of the sidewalls 142 of the sleeve element 140. However, the tab on the edge corresponding to the sidewall 142 featuring the hole 146 may be left unglued, whereby the unglued tab will act as the stopping mechanism hindering complete removal of the tray element 120 from the pocket of the sleeve element 140.

This disclosure should not be limited to the use of one button 180 for the locking and unlocking of the container 100. The container 100 may comprise two or more buttons 180 located between the foam insert 160 and the tray element 120 and extend distally through two or more holes 126 of the tray element 120 and two or more holes 146 of the sleeve element. Thereby, a user must simultaneously depress the two or more buttons 180 in order to partially remove the tray element 120, in accordance with the disclosure above. The two or more buttons 180 may be located laterally to one another, above and below one another, or on opposite or adjacent faces. Further, it is within the object of this disclosure that while the container may only feature one button 180, the sleeve element 140 feature multiple holes on differing locations and faces of the sidewalls 142, wherein the tray element 120 may enter the pocket of the sleeve element 140 in differing orientations and the button 180 will engage at least one hole 146.

Any reference in this specification to "one embodiment," "an embodiment," an "example embodiment," etc., means that a particular feature, structure, or characteristic described in connection with the implementation is included in at least one embodiment of the invention. The appearances of such phrases in various places in the specification are not necessarily referring to the same embodiment. In addition, any elements or limitations of any invention or embodiment thereof disclosed herein can be combined with any and/or all other elements or limitations (individually or in any combination) or any invention or embodiment thereof disclosed herein, and all such combinations are contemplated with the scope of the invention without limitation thereto.

It should be understood that the examples and embodiments described herein are for illustrative purposes only and that various modifications or changes in light thereof will be suggested to persons skilled in the art and are to be included within the spirit and purview of this application.

The invention claimed is:

1. A lockable container comprising:

a tray element, the tray element comprising a base and at least one wall;

the base and the at least one wall surrounding an open area;

the at least one wall comprising a hole therethrough;

a sleeve element having at least three sidewalls, the sidewalls defining a pocket, the pocket having at least one entrance, and the pocket adapted for receiving and housing the tray element;

at least one sidewall having a hole therethrough;

wherein the dimensions of pocket of the sleeve element correspond to the dimensions of the tray element;

wherein the hole of the tray element is substantially aligned with the hole of the sleeve element when the tray element is housed within the sleeve element; and wherein the size of the hole of the tray element is substantially equal to that of the hole of the sleeve element;

a foam insert, the foam insert residing within the open area proximate the hole of the tray element and extending the width of the base of the tray element;

a button, the button disposed between the tray element and the foam insert and extending distally through the hole of tray element;

wherein the button further extends distally through the hole of the sleeve element when the tray element is completely housed within the sleeve element;

wherein the button is adapted for depressing upon the foam insert whereby the button does not extend into the hole of the sleeve element allowing the tray element to be partially removed from the pocket of the sleeve element;

wherein the tray element may be partially removed from the pocket of the sleeve element when the button is depressed.

2. The container of claim 1, wherein an inner face of the sidewall of the sleeve element comprises a stopping mechanism obstructing the tray from being completely removed from the sleeve element.

3. The container of claim 2, wherein the stopping mechanism is a flap folded inwardly into the pocket from an edge of the entrance to the sleeve element.

4. The container of claim 1, wherein the sleeve element further comprises an opening at an end opposite of the entrance of the pocket.

5. The container of claim 1, wherein the sleeve element is manufactured as a single piece.

6. The container of claim 5, wherein the single piece sleeve element further comprises one or more tabs disposed on an edge of the entrance to the pocket, the one or more tabs folded inwardly and adapted to reside within the pocket.

7. The container of claim 6, wherein one tab is located on the edge of the entrance of the pocket of the sleeve element that corresponds to the side of the tray element that features the button, the tab adapted for engaging the button and obstructing complete removal of the tray element from the sleeve element.

8. The container of claim 7, wherein the one or more tabs that are not corresponding to the side of the tray element that features the button are glued to an inner face of the sidewalls of the sleeve element.

9. The container of claim 1, wherein the sleeve element further comprises a secondary hole through the same sidewall featuring the hole of the sleeve element, said secondary hole located proximate the entrance of the pocket and adapted for allowing the button to expand outwardly through the secondary hole, whereby the tray element may be locked in a partially removed position.

* * * * *